US007472839B2

(12) United States Patent
Yasukawa et al.

(10) Patent No.: US 7,472,839 B2
(45) Date of Patent: Jan. 6, 2009

(54) FUEL INJECTOR

(75) Inventors: Yoshihito Yasukawa, Hitachinaka (JP); Noriyuki Maekawa, Kashiwa (JP); Motoyuki Abe, Hitachinaka (JP); Nobuaki Sekiya, Isesaki (JP); Masahiro Soma, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 110 days.

(21) Appl. No.: 11/543,190

(22) Filed: Oct. 5, 2006

(65) Prior Publication Data

US 2007/0080239 A1 Apr. 12, 2007

(30) Foreign Application Priority Data

Oct. 6, 2005 (JP) ..... 2005-293797

(51) Int. Cl.
*B05B 1/24* (2006.01)
*B05B 1/30* (2006.01)
*F02M 47/02* (2006.01)

(52) U.S. Cl. ..... 239/135; 239/128; 239/88; 239/533.12; 239/584

(58) Field of Classification Search ..... 239/135, 239/128, 130, 133, 139, 88, 89, 91–95, 533.2, 239/533.11, 533.12, 533.14, 585.1–585.5, 239/584; 251/129.15, 129.21, 127
See application file for complete search history.

(56) References Cited

U.S. PATENT DOCUMENTS 5,465,910 A * 11/1995 Hall et al. ..... 239/585.4
5,494,223 A * 2/1996 Hall et al. ..... 239/585.5
5,544,816 A * 8/1996 Nally et al. ..... 239/585.5
6,102,303 A * 8/2000 Bright et al. ..... 239/135
2001/0052553 A1 12/2001 Hokao
2005/0056710 A1 3/2005 Sekiya et al.

FOREIGN PATENT DOCUMENTS

| | | | |
|---|---|---|---|
| DE | 198 43 317 | A1 | 3/2000 |
| JP | 2002-004973 | A | 1/2002 |
| JP | 2002-004974 | A | 1/2002 |
| JP | 2003-049739 | A | 2/2003 |
| JP | 2006-046229 | A | 2/2006 |
| WO | WO 00/52323 | A1 | 9/2000 |

OTHER PUBLICATIONS

European Search Report dated Jan. 12, 2007 (six (6) pages).

* cited by examiner

*Primary Examiner*—Davis D Hwu
(74) *Attorney, Agent, or Firm*—Crowell & Moring LLP

(57) ABSTRACT

A heating time period is decreased by that a valve body including a hollow valve shaft is arranged in a slidable manner in a cylindrical part of a casing on which a nozzle body with a valve seat is mounted at a front end thereof, a fuel is introduced from a fuel outlet port opening on a shaft wall of the valve shaft into a fuel path formed by the valve shaft and the cylindrical part, the fuel is heated to be injected from the nozzle body by a heater arranged at an outside of the fuel path of the cylindrical part, and a sleeve is mounted in the fuel path so that a large diameter part thereof closes the fuel path at an upper area of the fuel outlet port, while a fuel inlet port is formed on a small diameter part of the sleeve to introduce the fuel into the fuel path, so that the fuel path is narrowed to decrease an amount of the fuel to be heated by the heater.

10 Claims, 9 Drawing Sheets

FUEL INJECTOR

BACKGROUND OF THE INVENTION

The present invention relates to a fuel injection valve to be mounted on an internal combustion engine, particularly to a technique for atomizing a fuel injected at a start of an operation of the internal combustion engine.

A fuel injection valve to be mounted onto an internal combustion engine controls an amount of the injected fuel and atomizes the fuel to be injected from an injection port into an intake manifold or combustion chamber of the internal combustion engine. Particularly, since a temperature of the engine is low when the operation of the internal combustion engine is started, there is a probability of that the injected fuel adheres to a wall surface of the intake tube or combustion chamber to decrease a combustion efficiency so that an exhausted amount of unburnt component such as Hydro-carbon or the like is increased. Therefore, the pressurized fuel is injected while decreasing the pressure thereof or the heated fuel is injected so that the atomization and vaporization are accelerated to decrease the exhausted amount of Hydro-carbon.

For example, in a fuel injection valve disclosed by JP-A-2002-4973, an inside of a valve shaft is made hollow, and the valve shaft is formed by a base portion slidable in a cylindrical part of a valve body casing and a shaft portion whose diameter is smaller than that of the base portion to form a fuel path between the shaft portion of the smaller diameter and an inner surface of the valve body casing to communicate with a valve seat so that the fuel is supplied into the fuel path from a fuel outlet port formed on a wall of the valve shaft. Particularly, it is proposed that a heater is arranged on an outer surface of the valve body casing over the fuel path to heat the fuel, and a diameter of a part of the valve shaft over which the heater is arranged is increased to narrow the fuel path to increase a thermal conductivity to the fuel.

BRIEF SUMMARY OF THE INVENTION

An object of the present invention is to provide a fuel injection valve by which a heating time period is decreased without a deterioration of characteristic of a seat of a valve body.

A fuel injection valve of the invention comprises a casing including a hollow cylindrical part in which a fuel flows, a nozzle body arranged at a front end of the cylindrical part of the casing and including a valve seat, a hollow valve shaft in which the fuel flows and which has a base portion slidable in the cylindrical part of the casing and a shaft portion with a diameter smaller than a diameter of the base portion, a valve body arranged at a front end of the valve shaft to be moved by the valve shaft driven axially to contact with and be separated from the valve seat, a fuel outlet port opening on a shaft wall of the valve shaft, a cylindrical fuel path formed between the shaft portion of the valve shaft and an inner surface of the cylindrical part of the casing to communicate with the valve seat, a heater arranged at an outside of the fuel path on the casing, and a cylindrical partition member arranged between the shaft portion of the valve shaft and the inner surface of the cylindrical part of the casing and fixed to the casing, wherein the partition member including a large diameter part closing the fuel path formed at an upper area with respect to the fuel outlet port, a small diameter part having a diameter smaller than an inner diameter of the cylindrical part of the casing and arranged at a lower area with respect to the fuel outlet port, and a fuel inlet port arranged on the small diameter part to be aligned with the fuel outlet port.

Since the fuel path above the fuel outlet port is closed by the large diameter part of the partition member in this structure, the fuel is restrained from being convected in the fuel path above the fuel outlet port. Therefore, an amount of the fuel to be heated by the heater is decreased to shorten a time period for heating the fuel. Further, since the fuel path is narrowed by the partition member, the valve shaft does not need to be machined. Therefore, a seat characteristic of the valve body is prevented from being deteriorated by machining the valve shaft, so that an injection performance is maintained.

In the above case, it is preferable that a volume of the fuel path defined by the partition member is not less than an amount of the fuel to be injected by one stroke at a start of an operation of an internal combustion engine. By this, the amount of the fuel necessary for the start of the operation is kept while the fuel is heated instantly, so that an amount of exhausted Hydro-carbon is decreased. Incidentally, the amount of the fuel to be injected at the one stroke is a total amount injected by a plurality of pulses in a case of a pulse injection control.

Further, the large diameter part and the small diameter part may be formed integrally as a sleeve including a through hole through which the valve shaft extends. Alternatively, if the partition member is a sleeve including a cylindrical body corresponding to the small diameter part, a diameter of whose end is expanded to form the large diameter part, the machining is simplified. Further, if the partition member is a sleeve including a cylindrical body made of synthetic resin as the small diameter part and a metallic ring as the large diameter part surrounding the cylindrical body, a thermal conduction toward the small diameter part of synthetic resin is restrained to further shorten the time period for heating.

Further, it is preferable that the heater is a thin film heater including a resin film and a heating wire on the resin film. By this, an outer diameter of the fuel injection valve is restrained from increasing, so that it is easily mounted on the internal combustion engine. In this case, if the thin film heater is fixed to an outer surface of the casing to be aligned at least with the small diameter part of the partition member, the fuel in the fuel path to be supplied to the valve seat is heated effectively. Further, if a wall part of the casing on which the thin film heater is fixed is thin, an efficiency in the thermal conduction to the fuel is increased to further shorten the time period for heating the fuel. Further, if the thin film heater is made off when a temperature of an exhaust gas of an internal combustion engine is not less than a predetermined temperature, an unnecessary electric power is restrained from being consumed.

In a fuel injection valve for injecting a fuel, comprising: a hollow cylindrical casing including at an end thereof an opening through which the fuel is capable of being injected, a valve shaft arranged in the hollow cylindrical casing and movable with respect to the hollow cylindrical casing to open and close the opening, and a heater arranged on the hollow cylindrical casing to heat the fuel, the fuel injection valve further comprises a sleeve surrounding the valve shaft to form a fuel path between an outer periphery of the sleeve and an inner periphery of the hollow cylindrical casing so that the fuel is capable of flowing through the fuel path toward the opening in an axial direction of the valve shaft and stationary with respect to the hollow cylindrical casing so that the valve shaft is movable with respect to the sleeve.

Since the sleeve surrounds the valve shaft to form the fuel path between the outer periphery of the sleeve and the inner periphery of the hollow cylindrical casing so that the fuel is capable of flowing through the fuel path toward the opening in the axial direction of the valve shaft and stationary with respect to the hollow cylindrical casing so that the valve shaft is movable with respect to the sleeve in the axial direction, the flow path for enabling the fuel to flow along the valve shaft in the axial direction is narrowed by the sleeve while a radial distance between the heater and the flow path is kept small so that the fuel is heated effectively by the heater to decrease a time period for heating the fuel with the heater.

If at least a part of the heater overlaps at least a part of the fuel path as seen in a radial direction of the valve shaft, the fuel is heated further effectively by the heater.

If the sleeve has a relatively great diameter outer peripheral surface contacting the inner periphery of the hollow cylindrical casing and a relatively small diameter outer peripheral surface defining a part of the fuel path, the relatively great diameter outer peripheral surface further narrows the fuel path to further decrease the time period for heating the fuel with the heater.

If the sleeve has a through hole extending radially to enable the fuel to flow radially outward through the sleeve to the fuel path, a reception of the fuel by the fuel path is facilitated to make a flow rate of the fuel through the fuel path as great as possible to further decrease the time period for heating the fuel with the heater.

If as seen in the axial direction, an area of an annular clearance between the sleeve and the hollow cylindrical casing is greater than an area of an annular clearance between the sleeve and the valve shaft, the flow rate of the fuel through the fuel path as great as possible to further decrease the time period for heating the fuel with the heater.

According to the invention, a structure for the fuel injection valve enabling the time period for heating to be shortened without a deterioration of the seat characteristic of the valve shaft, is provided.

Other objects, features and advantages of the invention will become apparent from the following description of the embodiments of the invention taken in conjunction with the accompanying drawings.

DETAILED DESCRIPTION OF THE INVENTION

Hereafter, an embodiment of fuel injection valve to which the invention is applied, is explained with making reference to the drawings.

Embodiment 1

Figure 1:
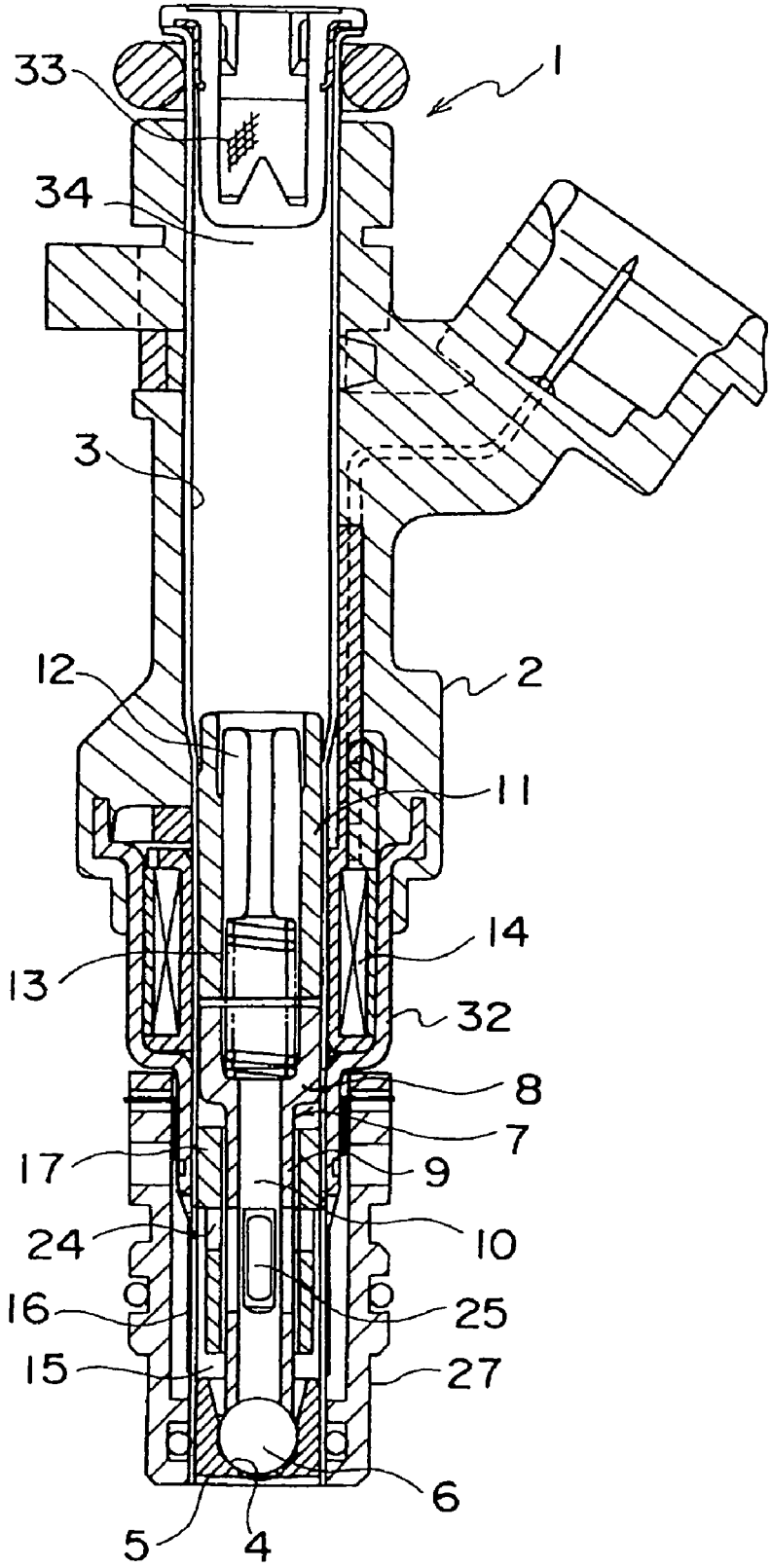
FIG. 1 is a cross sectional view of fuel injection valve of embodiment 1 of the invention.
Figure 2:
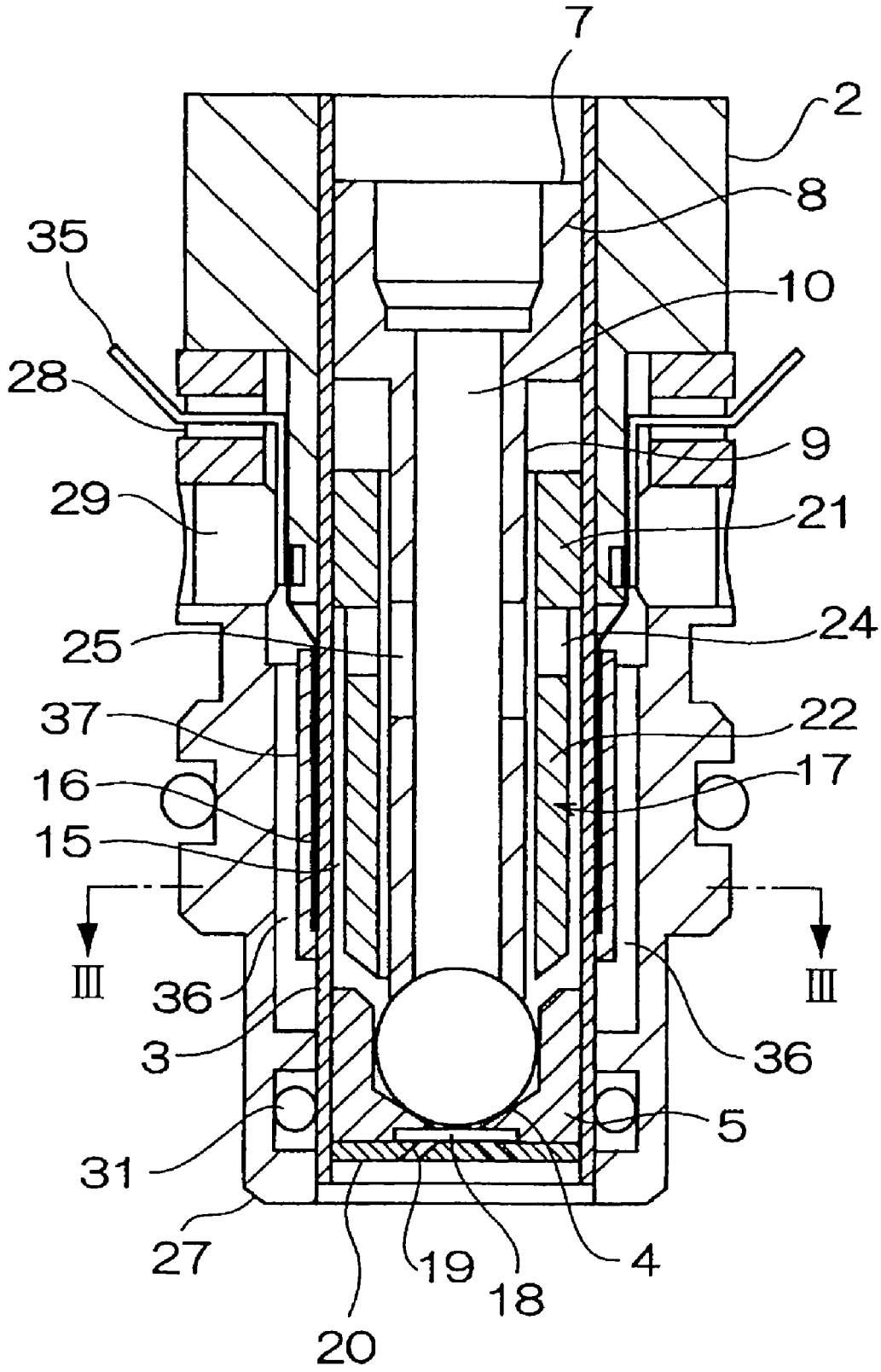
FIG. 2 is an enlarged cross sectional view of distinctive feature of the embodiment 1.
Figure 3:
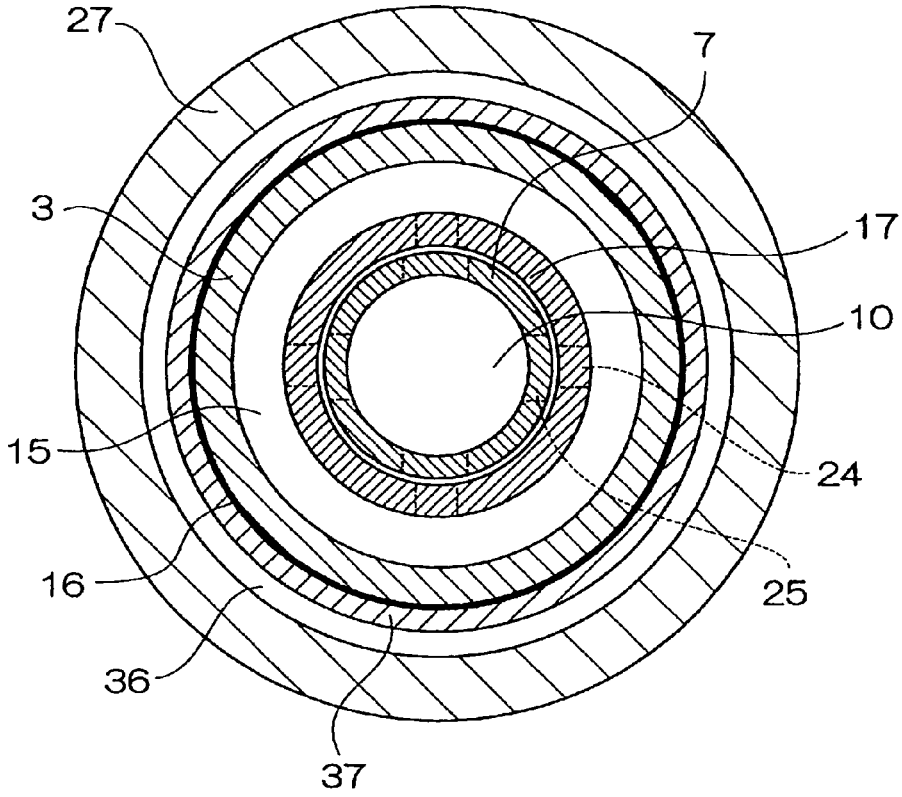
FIG. 3 is a cross sectional view along A-A in FIG. 2.
Figure 4:
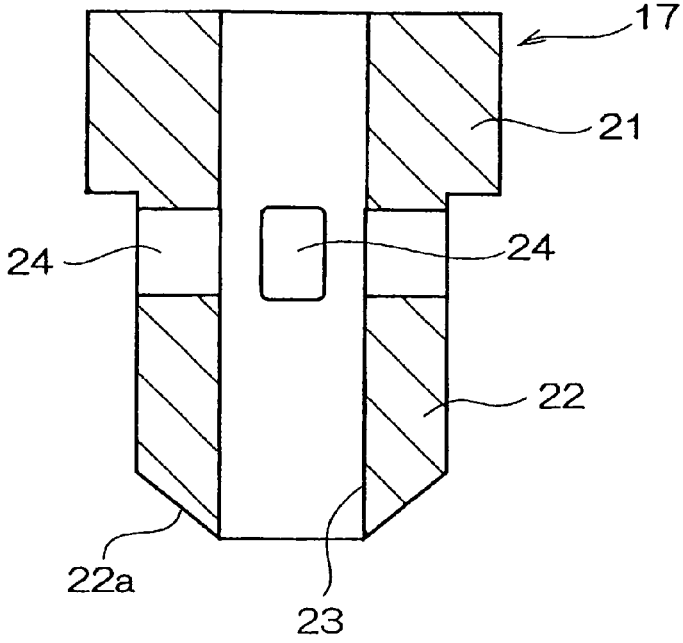
FIG. 4 is a cross sectional view of sleeve of the embodiment 1.

The embodiment 1 of fuel injection valve to which the invention is applied, is explained on the basis pf FIGS. 1-4. FIG. 1 is a longitudinal cross sectional view of the fuel injection valve of the first embodiment, FIG. 2 is a longitudinal cross sectional view enlarging a distinctive feature in FIG. 1, FIG. 3 is a cross sectional view taken along line A-A of FIG. 2, and FIG. 4 is a cross sectional view of a sleeve as the distinctive feature of the first embodiment.

As shown in FIGS. 1 and 2, in a fuel injection valve 1 of the embodiment, a cylindrical body 3 of thin plate is arranged in a hollow cylindrical part of a casing 2, and a nozzle body 5 with a valve seat 4 is attached to a front end of the cylindrical body 3. A valve shaft 4 at a front end of which a spherical valve body 6 is fixed is arranged in the cylindrical body 3. The valve shaft 7 has a base part 6 axially slidable in the cylindrical body 3 and a shaft part 9 of smaller diameter than the base part 8 so that a space 10 for a flow of the fuel is formed. A hollow core 11 is fixed to the cylindrical body 3 above the valve shaft 7. A spring adjuster 12 is mounted in the core 11 to adjust an elastic force of a spring 13 for pressing the valve body 6 against the valve seat 4. Further, an electromagnetic coil 14 is arranged on an outer periphery of the cylindrical body 3 in which the core is arranged so that the base part 8 of the valve shaft 7 is drawn by the core 11 to separate the valve body 6 from the valve seat 4 when the electromagnetic coil is excited.

Further, a cylindrical fuel path 15 is formed by the shaft part 9 of the valve shaft 7 and an inner surface of the cylindrical body 3 to communicate with the valve seat 4. Further, a heater 16 is fixed at an outside of the cylindrical body 3 over the fuel path 15. Further, a cylindrical sleeve 17 as a partition member is fixed to the cylindrical body 3 in the fuel path 15. Further, as shown in FIG. 2, a fuel injection chamber 18 is formed on a front end surface of a nozzle body 5 to communicate with the valve seat 4, and an injection holes plate 20 including a plurality of fuel injection holes 19 closes the fuel injection chamber 18. Incidentally, in FIG. 1, reference numeral 32 denotes a yoke of magnetic material, reference numeral 33 denotes a filter, and reference numeral 34 denotes a fuel supply path.

Next, with making reference to FIGS. 2-4, the distinctive feature of the embodiment 1 relating to the fuel path 15, heater 16 and sleeve 17 will be explained. The sleeve 17, as shown in FIG. 4, includes a cylindrical large diameter part 21 and a cylindrical small diameter part 22, and a through hole 23 through which the valve shaft 7 extends. A tapered surface 22*a* is formed on an lower end of the small diameter part 22. Further, a plurality of fuel inlet ports 24 are arranged circumferentially on the small diameter part 22 adjacently to the large diameter part 21. The sleeve 17 of the embodiment is formed by a cutting process. Further, with taking a cost reduction into consideration, it may be produced by the cutting process after its outer shape is formed by sintering or molding process.

Such sleeve 17 is fixedly attached at the large diameter part 21 to the cylindrical body 3 by welding or the like so that the fuel inlet ports 24 are arranged to be aligned with the fuel outlet ports 25 formed circumferentially on a shaft wall of the valve shaft 7. As explaining concretely, the sleeve 17 are pressed into the cylindrical body 3 of the casing 2, and the outer periphery of the large diameter part 21 is mechanically fixed to the cylindrical body 3 by spot-welding or the like. therefore, the fuel is guided from the fuel path 15 to the valve seat 4.

Further, the large diameter part 21 is arranged above the fuel outlet port 25 of the valve shaft 7. Therefore, the large diameter part 21 closes the fuel path 15 above the fuel outlet port 25. Further, an outer diameter of the small diameter part 22 is smaller than an inner diameter of the cylindrical body 3 to narrow a cross sectional area of the fuel path 15 below the large diameter part 21.

The fuel inlet ports are not limited to rectangular shapes, but may be circular and/or an axis thereof may be inclined with respect to a radial direction. Further, the fuel outlet ports 25 are elongated in a movable direction of the valve shaft 7 so that the fuel inlet ports 24 and the fuel outlet ports 25 mutually communicate even when the valve shaft 7 moves in accordance with opening and closing operation of the valve.

The heater 16 are arranged at the outer peripheral surface of the cylindrical body 3 at a position corresponding to the small diameter part 22 of the sleeve 17. The heater 16 of the embodiment is a thin film heater in which a heating wire (for example, stainless steel) is arranged on a resin (for example, polyimide) film. Therefore, a thickness thereof can be decreased to about 30-70 μm so that a temperature increasing characteristic of the heater is improved. Incidentally, a PTC heater or the like with a self control function for heating the fuel are usable.

Further, for improving a close contact between the heater 16 and the cylindrical body 3, a heat shrinkable tube 37 shrinking by heating to generate a shrinking force is arranged around the heater 16. Therefore, a clearance or the like is prevented from being formed between the heater 16 and the cylindrical body 3 so that a thermal energy is effectively transmitted to the fuel. In this embodiment, a thickness of the heat shrinkable tube 37 is about 0.5 mm. Therefore, the heater 16 and the heat shrinkable tube 37 are thin so that an outer diameter of a case member 27 does not need to be large, that is, is compact to be easily mounted on the intake tube or fuel chamber.

Incidentally, an electric source is supplied to the heater 16 from the outside through a heater terminal 35. The heater terminal 35 is inserted from a slit-shaped insert hole 28 on the case member 17 to be connected to the heater 16. Incidentally, the case member 27 fixes the fuel injection valve 1 to an internal combustion engine. Further, the heater terminal 35 is pressed by a threaded fixing member at a heater fixing hole 29 of the case member 27 to be fixed to securely contact the heater 16. Further, the heater 16 is arranged in a cavity 36 formed between the cylindrical body 3 and the case member 27 covering the heater 16 so that a thermal energy is restrained by an air layer in the cavity 36 from being discharged.

Figure 5:
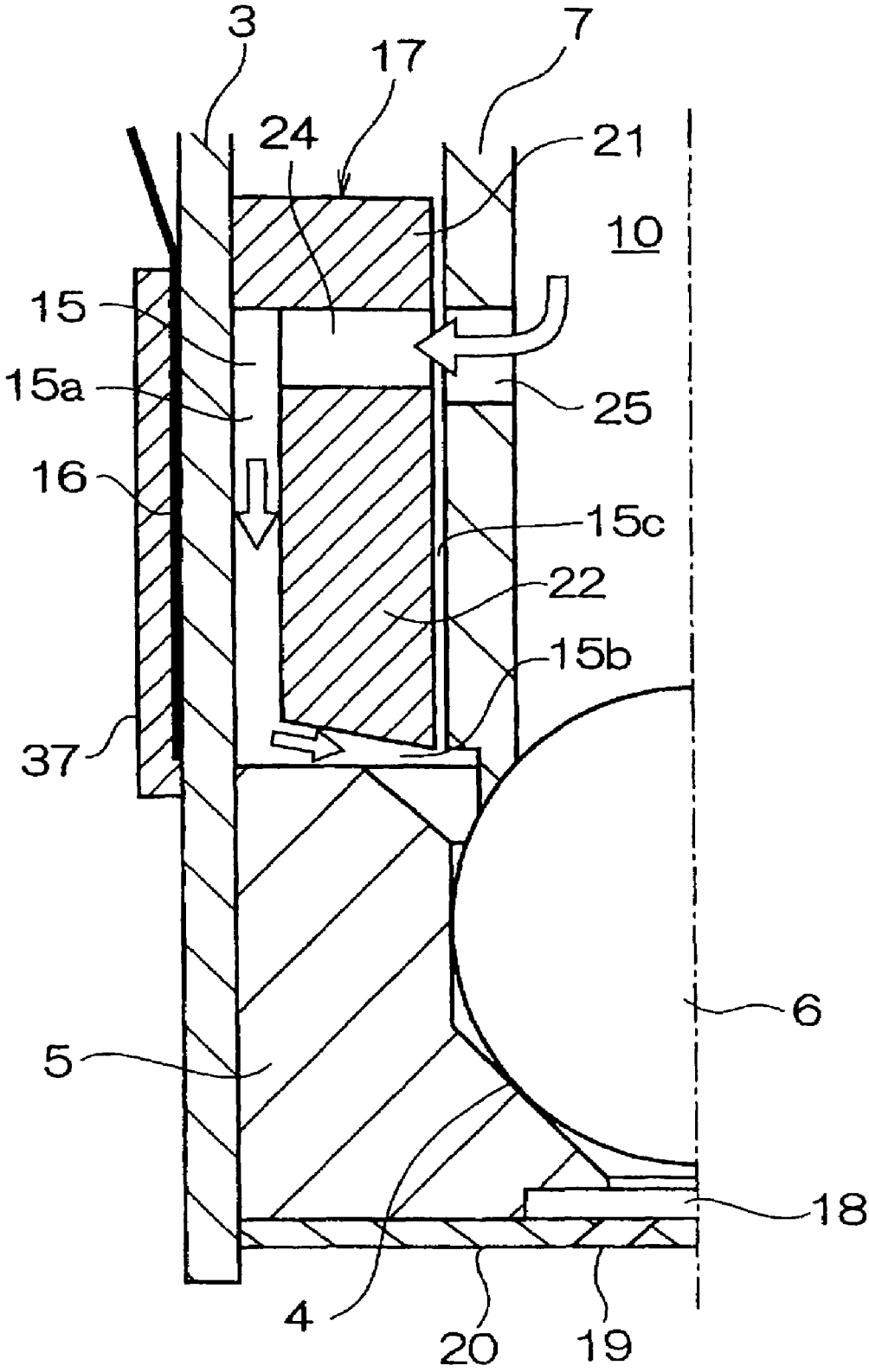
FIG. 5 is a view for explaining action of the embodiment 1.

Next, an action of the fuel injection valve of the embodiment 1 as described above will be explained. The fuel is supplied to a fuel supply path 34 through the filter 33. The fuel is, as shown in FIG. 5, introduced from the fuel supply path 34 to the fuel path 15 through a cavity 10 of the valve shaft 7, the fuel outlet ports 25 on the shaft part 9 and the fuel inlet ports 24 on the sleeve 17. The fuel path 15 includes a clearance 15*a* formed between the small diameter part 22 of the sleeve 17 and the inner surface of the cylindrical body 3 of the casing 2, and a clearance 15*b* formed between an lower end surface of the small diameter part 22 and an upper end surface and valve seat area of the nozzle body 5. Incidentally, a clearance between the through hole 23 of the sleeve 17 and the valve shaft 7 is formed as a tolerance enabling the valve shaft 7 to move freely in the sleeve 17.

When a key is on to start the internal combustion engine, a cranking is started, and the electromagnetic coil 14 is excited by a fuel controller (not shown) so that the valve body 6 on the valve shaft 7 and the valve seat separate from and contact with each other in pulse mode. Therefore, the fuel is introduced from the fuel path into the fuel injection chamber 18 through the valve seat 4 to be injected from the injection holes 19 into the intake tube or the combustion chamber so that the operation of the internal combustion engine is started.

On the other hand, simultaneously with the key-on or before the key-on, an electricity starts to be supplied to the heater 16. Therefore, the fuel in the fuel path 15 is heated through the cylindrical body 3 of thin plate. Since a time period until the fuel is injected to the operation start is short (for example, about 1 second), the fuel in the fuel path 15 needs to be rapidly heated to a predetermined temperature (for example, 80-100° C.) to accelerate the atomization. In the embodiment 1, since the fuel path 15 is closed by the large diameter part of the sleeve 17 above the fuel outlet ports 25, the fuel in the fuel path 15 is not heated above the fuel outlet ports 25. Further, since the fuel path 15 is narrowed by the small diameter part of the sleeve 17, an amount of the fuel to be heated by the heater 16 is significantly decreased. Further, since the fuel discharged from the fuel inlet ports 24 of the sleeve 24 to the fuel path 15 impinges on the inner surface of the cylindrical body 3 on which the heater 16 is arranged, the thermal conduction to the fuel is improved. Therefore, since the thermal energy of the heater 16 is directly transmitted to the fuel in the clearance 15*a* as the narrowed fuel path 15 through the thin cylindrical body 3, the fuel for starting the operation can be rapidly heated to the predetermined temperature so that the atomized fuel is injected and an amount of exhausted hydro carbon is decreased at the operation start.

Incidentally, as shown in FIG. 5, the cross section of the clearance 15*c* is significantly smaller than the cross section of the clearance a. For example, the clearance 15*c* is about some micrometers, and the clearance 15*a* is several hundred micrometers. In such concentric annular clearances, since a flow rate of the fuel through each of the clearances is in proportion to cubic of the clearance and in inverse proportion to a length of the clearance, a major part of the fuel introduced from the fuel inlet ports 24 flows through the clearance 15*a*.

Figure 6:
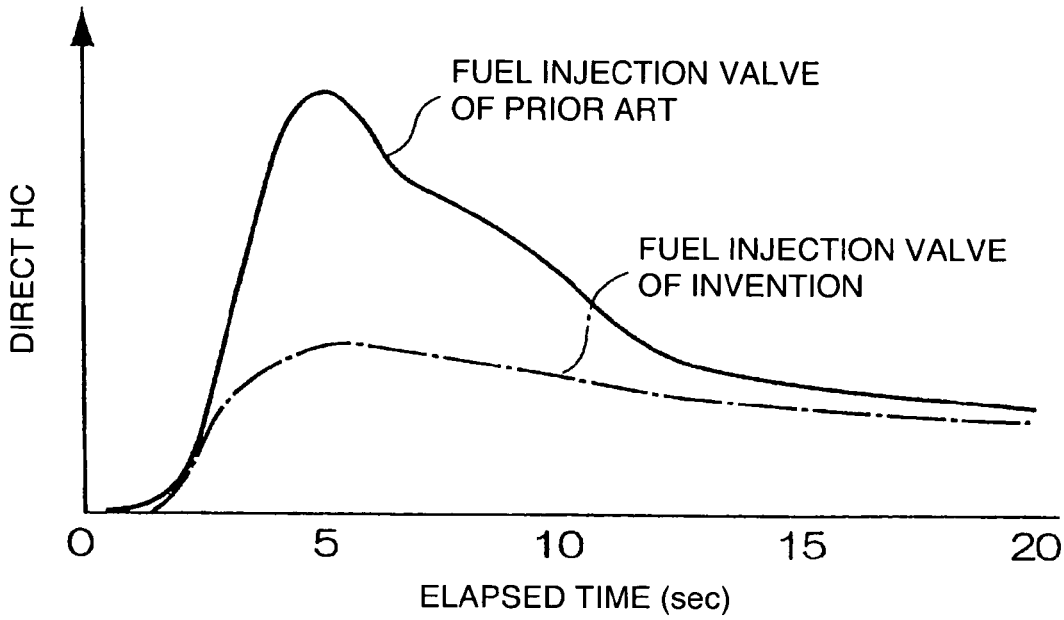
FIG. 6 is a view showing a variation in amount of hydro carbon discharged from internal combustion engine along a time elapse.

A decrease in exhausted amount of hydro carbon at the operation start in the embodiment 1 is explained with making reference to FIG. 6. In this drawing, a variation in exhausted amount of hydro carbon at first idling (1200 rpm) during a time period of 20 seconds from the operation start of the internal combustion engine is shown. In the drawing, a temperature of the fuel at the operation start of a conventional fuel injection valve is 20° C., and a temperature of the fuel at the operation start of the fuel injection valve of the invention is 80° C. Usually, an amount of the injected fuel is, for example, about 260 $mm^3$ at first stroke from the operation start of the internal combustion engine, and it is decreased to, for example, about 20 $mm^3$ after the operation start (after an elapse of about 1 second) by A/F control.

As known from FIG. 6, in the conventional fuel injection valve, a peak value occurs at an elapse of 5 seconds from the operation start, and subsequently it decreased gradually. On the other hand, in the fuel injection valve of the invention, since the temperature of the fuel is sufficiently high at the operation start, the peak value of hydro carbon is kept low after the operation start. This difference is understandable from that in the conventional fuel injection valve, a major part of the injected fuel adheres to an inner wall surface of the intake tube or the combustion chamber, and subsequently is vaporized as an excessive fuel to be taken into the combustion chamber so that a rich fuel-air mixture is formed to increase hydro carbon after a temperature of the wall surface is increased by the combustion. Particularly, there is a probability of that hydro carbon is increased abruptly by a delay in burning the fuel kept in a piston clearance of the combustion chamber, whereby the fuel should be prevented from adhering to the inner wall surface of the intake tube or the combustion chamber. According to the invention, since the temperature of the fuel is rapidly increased to 80° C. at the operation start, the atomization and vaporization of the fuel is accelerated to restrain the fuel from adhering to the inner wall surface of the intake tube or the combustion chamber, so that the exhausted amount of hydro carbon is significantly decreased.

Further, since the fuel path 15 is narrowed by the sleeve 17, a diameter of the shaft part 9 of the valve body 7 does not need to be machined to be expanded, the seat characteristic of the valve seat 4 for the valve body 6 is prevented from being deteriorated by a plastic deformation by the machining. Further, it is preferable that a volume of a space formed by the clearances 15*a* and 15*b* of the fuel path 15 which volume may include a volume of a space from the clearance 15*b* to the valve seat 4, is not less than an amount of the fuel for one stroke or two strokes of the first idling operation after the operation start of the internal combustion engine.

Incidentally, in the above embodiment 1, since the large diameter part 21 of the sleeve 21 is fixed to the cylindrical body 3 of the casing 2 by welding or the like, the thermal energy of the heater 16 is used to heat the fuel in the fuel path 15 through the cylindrical body 3 and the sleeve 17. However, since an effect of the sleeve 17 for heating the fuel in the fuel path 15 is small, it is preferable that the sleeve 17 is made of a low thermal conductivity material (for example, titanium, stainless steel or the like). Therefore, the thermal energy for heating the sleeve 17 is usable for heating the fuel so that the time period for heating the fuel is further decreased.

Further, although the start of electrically excitation of the heater 16 is performed simultaneously with or before the key on in the above description, it is preferable that a so-called pre-heating as heating before an order of the fuel injection is performed to increase the temperature of the fuel as instantly as possible. Since the temperature of the fuel and the atmospheric temperature vary greatly, the heating before the injection enables the fuel to be effectively atomized when being injected at the operation start. For example, it is preferable that a time period of preheating before the injection is 1-5 seconds. Such preheating is performed along a condition setting mode. For example, the heater may be on in response to an output of a signal generated after some keywords are announced, after a driver opens a door, after a sensor detects that the driver sits down, or the like. Further, since the time period of the preheating cannot be determined at fixed value, it may be determined from the atmospheric temperature, fuel temperature, a voltage of battery or the like.

Further, as shown in FIG. 5, since the fuel does not need to be heated after the temperature of the internal combustion engine increases sufficiently, the heater 16 is made off to save the electric power when the temperature of the exhaust gas of the internal combustion engine becomes not less than the predetermined temperature. Incidentally, the predetermined temperature is, for example, sufficient for activating an exhaust gas purifier catalyst.

Hereafter, the structure of the embodiment 1 will be addition in detail. In the fuel injection valve 1, the injection rate control needs to be performed without a leakage of the fuel, particularly, the leakage of the fuel needs to be prevented to control the fuel supply rate in the valve closed situation by keeping the seat characteristic between the valve body 6 and the valve seat 4, and the structure needs to be produced by a mass production with a low cost. Therefore, in the embodiment 1, the spherical valve body 6 is used. As the valve body 6, for example, a steel ball for ball bearing with mirror surface finishing and high circularity along Japanese industrial standard is used, and it has a diameter of 3-4 mm for a weight saving. Further, an angle from a center of the valve body to seat surfaces at which the valve body 6 and the valve seat 4 contact each other is about 90 (80-100) degrees. Further, the vicinity of the seat surfaces of the valve seat 4 is polished by a grinder to improve the seat characteristic. Further, the nozzle body is hardened by quenching and degaussed to eliminate an excessive magnetism.

An O-ring 31 is arranged between the front end of the cylindrical body 3 and the case member to prevent water, fuel or the like from proceeding into the heater. A material of the case member 27 is a heat resisting synthetic resin (for example, a peak material).

Embodiment 2

Figure 7:
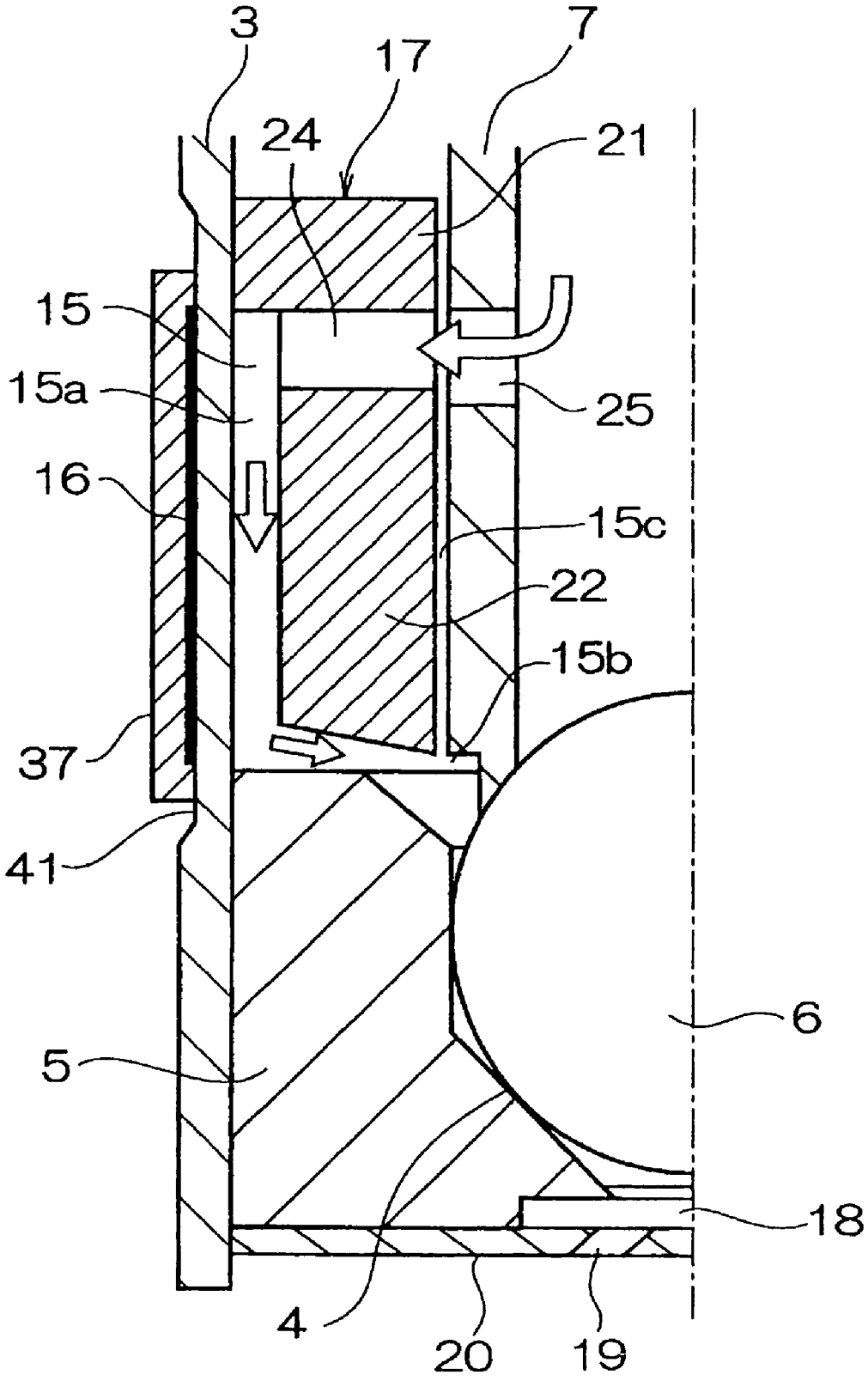
FIG. 7 is an enlarged cross sectional view of distinctive feature of fuel injection valve of embodiment 2 of the invention.

FIG. 7 is an enlarged cross sectional view showing a distinctive feature of the embodiment 2 of the fuel injection valve to which the invention is applied. The embodiment 2 is differentiated from the embodiment 1 by that a thickness of a part of the cylindrical body of the casing on which part the heater 16 is mounted is decreased. The embodiment 2 is equal to the embodiment 1 in other functions and structures, whereby the same reference codes are used to eliminate the explanation.

As shown in FIG. 7, a recess 41 is arranged on a part of outer surface of the cylindrical body 3 on which part the heater is mounted. The recess 41 extends from the vicinity of the upper end surface of the nozzle body 5 to its range corresponding to the large diameter part 21 of the sleeve 17 so that the heater is fixed closely onto the recess.

In the embodiment 2, the thermal conductivity from the heater 16 to the fuel is significantly improved in comparison with the first embodiment to heat effectively the fuel. It was confirmed that a reduction of 50% in thickness under the recess 41 causes an increase of about 25% in temperature increase of the fuel.

Embodiment 3

Figure 8:
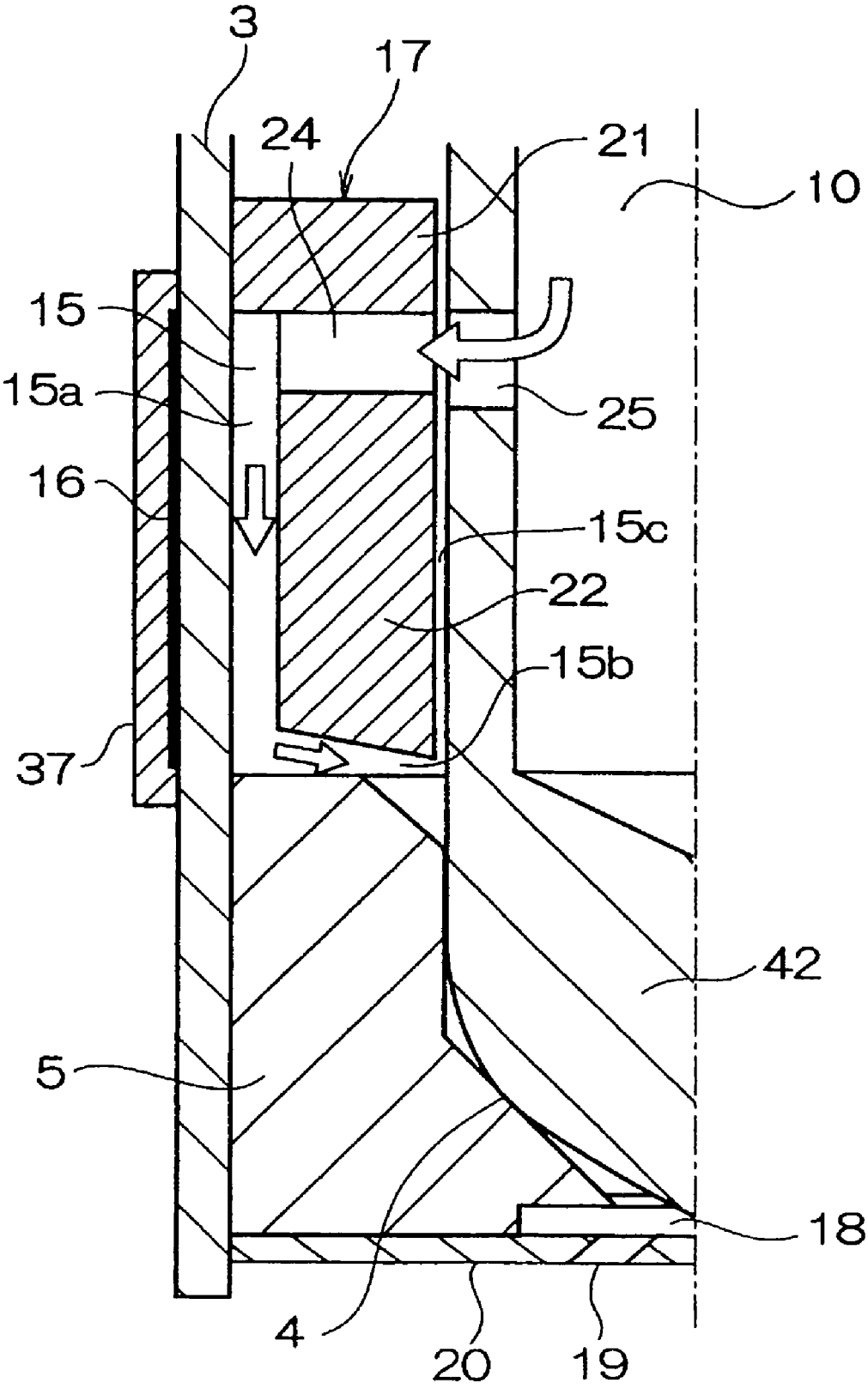
FIG. 8 is an enlarged cross sectional view of distinctive feature of fuel injection valve of embodiment 3 of the invention.

FIG. 8 is an enlarged cross sectional view showing a distinctive feature of the embodiment 3 of the fuel injection valve to which the invention is applied. The embodiment 3 is differentiated from the embodiment 1 by that a valve body 42 of needle shape is used as a substitute for the spherical valve body 6. The embodiment 3 is equal to the embodiment 1 in other functions and structures, whereby the same reference codes are used to eliminate the explanation.

In the embodiment 3, the valve body 42 if needle shape improves a smoothness in fuel flow through the clearance 15*b* at an upstream side with respect to the valve seat 4 in comparison with the embodiment 1, and a volume receiving the valve seat can be decreased in comparison with the spherical valve body 6. Therefore, an amount of the injected fuel heated insufficiently by the heater 16 is decreased to further decrease the exhausted amount of hydro carbon.

Embodiment 4

Figure 9A:
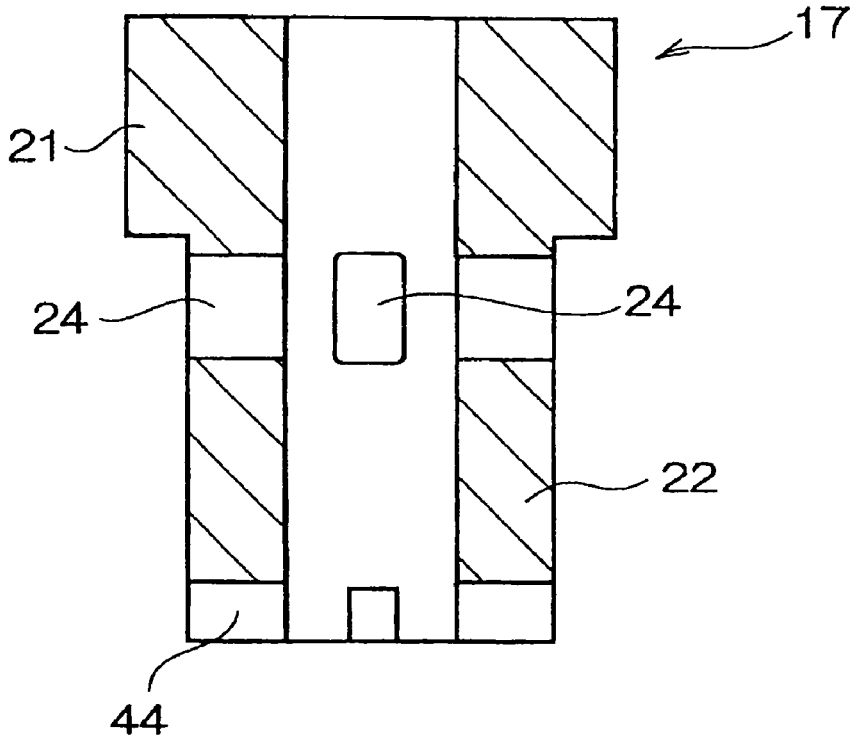
FIG. 9*a* is a longitudinal cross sectional view showing structure of embodiment 4 of the invention.
Figure 9B:
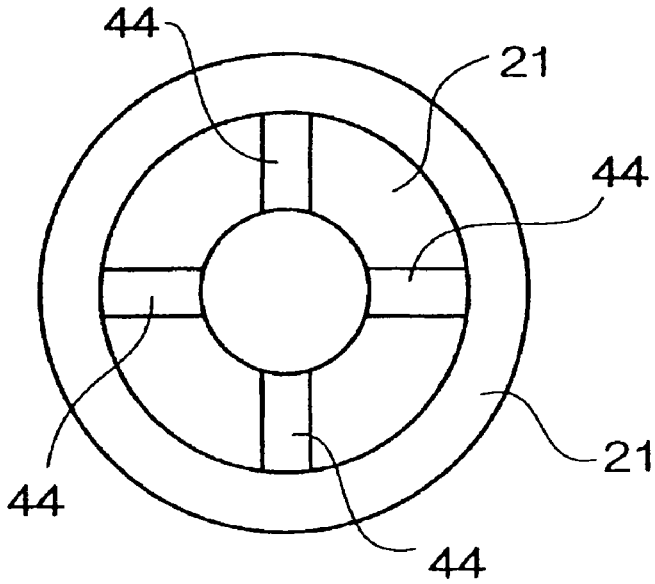
FIG. 9*b* is a bottom view showing structure of embodiment 4 of the invention.

FIG. 9 is a view showing a structure of a sleeve for the embodiment 4 of the fuel injection valve to which the invention is applied. A part (a) thereof is a longitudinal cross sectional view, and a part (b) thereof is a bottom view. The sleeve 17 of the embodiment 4 has a plurality of fuel passage grooves 44 at the lower end of the small diameter part 22 of the sleeve 17 of the first embodiment. The embodiment 4 is equal to the embodiment 1 in other functions and structures, whereby the same reference codes are used to eliminate the explanation.

The sleeve 17 of the embodiment 4 is positioned to make the lower end of the small diameter part 22 contact the upper end surface of the nozzle body 5. Therefore, the clearance 15*b* shown in FIG. 5 is decreased to decrease its volume. Therefore, the mount of the injected fuel insufficiently heated by the heater 17 is decreased in comparison with the embodiment 1 to further decrease the exhausted amount of hydro carbon. Further, its axial positioning is facilitated.

Embodiment 5

Figure 10:
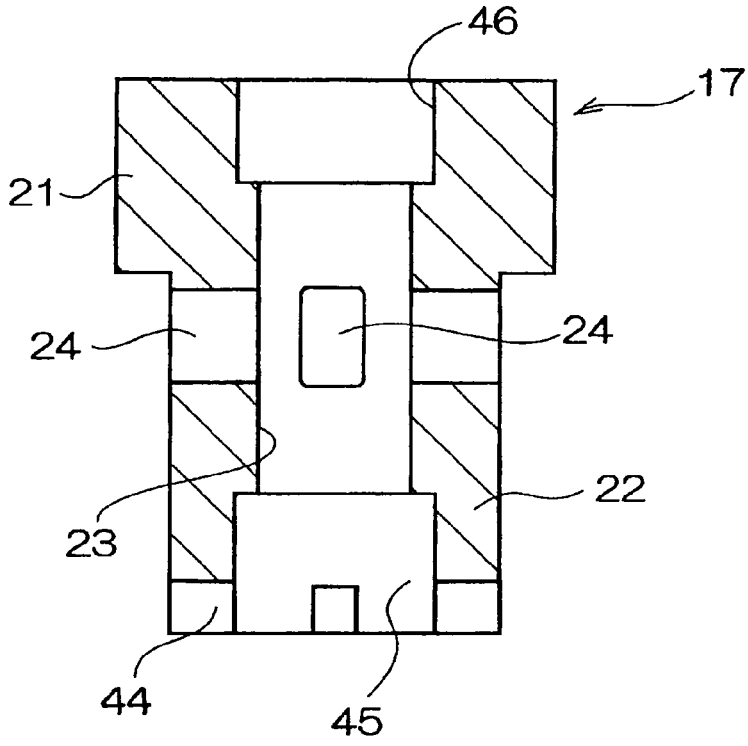
FIG. 10 is a cross sectional view of sleeve of embodiment 5 of the invention.

FIG. 10 is a longitudinal cross sectional view showing a sleeve of the embodiment 5 of the fuel injection valve to which the invention is applied. In the sleeve 17 of the embodiment 5, a diameter of the through hole 23 of the sleeve 17 of the embodiment 1 is expanded at upper and lower ends respectively. The embodiment 5 is equal to the embodiment 1 in other functions and structures, whereby the same reference codes are used to eliminate the explanation.

The sleeve 17 of the embodiment 5 has expanded diameter areas 45 and 46 greater than the through hole 23 at the upper and lower ends of the through hole 23.

Accordingly, in the embodiment 5, an area contacting with the shaft part 9 of the valve shaft 7 is decreased in comparison with the embodiment 4. Therefore, a sliding characteristic of the valve shaft 7 is improved in comparison with the embodiments 1-4.

Embodiment 6

Figure 11:
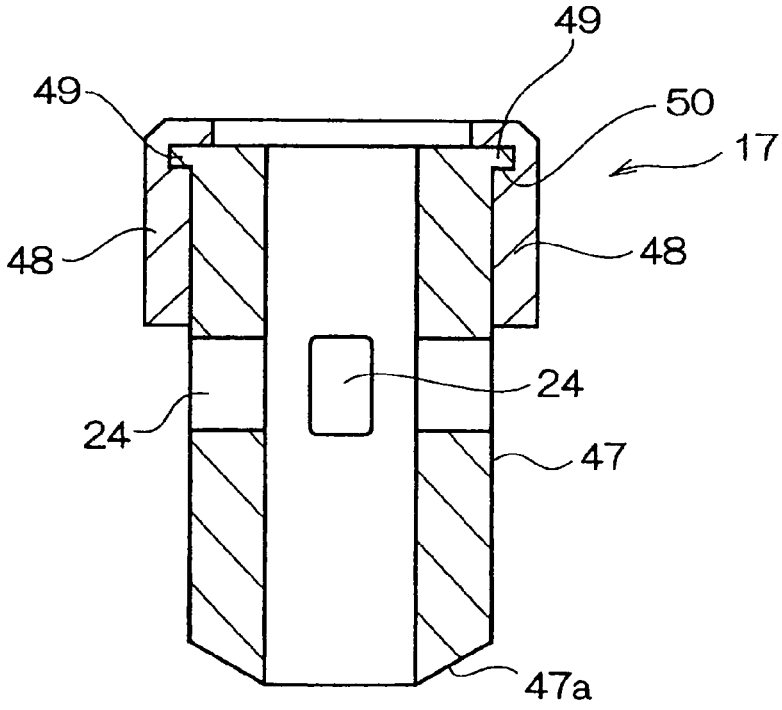
FIG. 11 is a cross sectional view of sleeve of embodiment 6 of the invention.

FIG. 11 is a longitudinal cross sectional view showing a sleeve of the embodiment 6 of the fuel injection valve to which the invention is applied. In the sleeve 17 of the embodiment 6, the sleeve 17 of the embodiment 1 is divided to the great diameter part and the small diameter part individual to each other. The embodiment 6 is equal to the embodiment 1 in other functions and structures, whereby the same reference codes are used to eliminate the explanation.

As shown in FIG. 11, the sleeve 17 of the embodiment 6 has a small diameter part 47 of cylindrical body made of synthetic resin as a substitute for the small diameter part 22 of the embodiment 1, and a large diameter part 48 of metallic ring covering an end of the small diameter part 47. Further, a jaw 49 is arranged at the upper end of the cylindrical body of the small diameter part 47, and a recess 50 is arranged on an inner surface of the ring of the large diameter part 48 to correspond to the jaw so that a mechanical fixing is formed. The lower end of the small diameter part 47 has a tapered surface 47*a*.

According to the embodiment 6, since the small diameter part 47 of the sleeve 17 is made of the synthetic resin, the thermal conductivity and volume of the sleeve 17 is decreased to restrain the thermal energy of the heated fuel from leaking to the sleeve. Therefore, the fuel can be further rapidly heated.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A fuel injection valve comprising a casing including a hollow cylindrical part in which a fuel flows, a nozzle body arranged at a front end of the cylindrical part of the casing and including a valve seat, a hollow valve shaft in which the fuel flows and which has a base portion slidable in the cylindrical part of the casing and a shaft portion with a diameter smaller than a diameter of the base portion, a valve body arranged at a front end of the valve shaft to be moved by the valve shaft driven axially to contact with and be separated from the valve seat, a fuel outlet port opening on a shaft wall of the valve shaft, a cylindrical fuel path formed between the shaft portion of the valve shaft and an inner surface of the cylindrical part of the casing to communicate with the valve seat, a heater arranged at an outside of the fuel path on the casing, and a cylindrical partition member arranged between the shaft portion of the valve shaft and the inner surface of the cylindrical part of the casing and fixed to the casing, wherein the partition member including a large diameter part closing the fuel path formed at an upper area with respect to the fuel outlet port, a small diameter part having a diameter smaller than an inner diameter of the cylindrical part of the casing and arranged at a lower area with respect to the fuel outlet port, and a fuel inlet port arranged on the small diameter part to be aligned with the fuel outlet port.

2. The fuel injection valve according to claim 1, wherein a volume of the fuel path defined by the partition member is not less than an amount of the fuel to be injected by one stroke at a start of an operation of an internal combustion engine.

3. The fuel injection valve according to claim 1, wherein the large diameter part and the small diameter part are formed integrally as a sleeve including a through hole through which the valve shaft extends.

4. The fuel injection valve according to claim 1, wherein the partition member is a sleeve including a cylindrical body made of synthetic resin as the small diameter part and a metallic ring as the large diameter part surrounding the cylindrical body.

5. The fuel injection valve according to claim 1, wherein the small diameter part including a plurality of grooves distant from each other circumferentially at a lower end of the small diameter part contacting an upper end surface of the nozzle body.

6. The fuel injection valve according to claim 1, wherein the partition member has a through hole through which the valve shaft extends, and diameters of both ends of the through hole are expanded.

7. The fuel injection valve according to claim 1, wherein the heater is a thin film heater including a resin film and a heating wire on the resin film.

8. The fuel injection valve according to claim 7, wherein the thin film heater is fixed to an outer surface of the casing to be aligned at least with the small diameter part of the partition member.

9. The fuel injection valve according to claim 8, wherein a wall part of the casing on which the thin film heater is fixed is thin.

10. The fuel injection valve according to claim 7, wherein the thin film heater is made off when a temperature of an exhaust gas of an internal combustion engine is not less than a predetermined temperature.

* * * * *